US009432779B2

(12) United States Patent
Kerselaers

(10) Patent No.: US 9,432,779 B2
(45) Date of Patent: Aug. 30, 2016

(54) HEARING AID ANTENNA

(71) Applicant: NXP B.V., Eindhoven (NL)

(72) Inventor: Anthony Kerselaers, Louvain (BE)

(73) Assignee: NXP B.V., Eindhoven (NL)

( * ) Notice: Subject to any disclaimer, the term of this patent is extended or adjusted under 35 U.S.C. 154(b) by 39 days.

(21) Appl. No.: 14/162,542

(22) Filed: Jan. 23, 2014

(65) Prior Publication Data

US 2014/0226844 A1 Aug. 14, 2014

Related U.S. Application Data

(63) Continuation-in-part of application No. 13/758,257, filed on Feb. 4, 2013.

(30) Foreign Application Priority Data

Feb. 8, 2013 (EP) ..... 13154708

(51) Int. Cl.

| | |
|---|---|
| ***H04R 25/00*** | (2006.01) |
| ***H01Q 1/27*** | (2006.01) |
| ***H01Q 9/28*** | (2006.01) |
| ***H01Q 9/16*** | (2006.01) |
| ***H01Q 1/44*** | (2006.01) |

(52) U.S. Cl.

CPC ..... *H04R 25/552* (2013.01); *H01Q 1/273* (2013.01); *H01Q 1/44* (2013.01); *H01Q 9/16* (2013.01); *H01Q 9/285* (2013.01); *H04R 25/55* (2013.01); *H04R 25/60* (2013.01); *H04R 2225/51* (2013.01); *Y10T 29/49016* (2015.01)

(58) Field of Classification Search

CPC ..... H01Q 1/243; H01Q 9/42; H01Q 1/48; H01Q 9/16; H01Q 13/10; H01Q 7/00; H01Q 1/273; H04R 25/552; H04R 25/60

See application file for complete search history.

(56) References Cited

U.S. PATENT DOCUMENTS

| | | | |
|---|---|---|---|
| 4,918,736 A | 4/1990 | Bordewijk | |
| 5,721,789 A | 2/1998 | Loffler | |
| 6,456,246 B2 * | 9/2002 | Saito | 343/702 |

(Continued)

FOREIGN PATENT DOCUMENTS

| | | |
|---|---|---|
| EP | 2 105 989 A2 | 9/2009 |
| WO | 2012/059302 A2 | 5/2012 |

OTHER PUBLICATIONS

Conway, G.A. et al., "An Analytical Path-Loss Model for on-Body Radio Propagation", URSI Int'l. Symp. on Electromagnetic Theory, pp. 332-335 (Aug. 2010).

(Continued)

*Primary Examiner* — Fan Tsang
*Assistant Examiner* — Angelica M McKinney

(57) ABSTRACT

An antenna, in particular a dipole antenna, for radio communication in a hearing aid, is disclosed. The antenna includes a solid three-dimensional dielectric support body, an electrically conductive first plate on a first surface of the support body and an electrically conductive second plate on a second surface of the support body. The first surface and the second surface are arranged on opposing ends of the support body. An electrically conductive filament is arranged on and/or in the support body, electrically coupling the first plate with the second plate, and comprising first sections and second sections. The second sections extend perpendicular to the first sections.

20 Claims, 4 Drawing Sheets

(56) References Cited

U.S. PATENT DOCUMENTS

| | | | | |
|---|---|---|---|---|
| 6,501,437 | B1 * | 12/2002 | Gyorko | H01Q 1/362 347/700 MS |
| 7,072,480 | B2 | 7/2006 | Rass | |
| 7,764,242 | B2 * | 7/2010 | Milyakh | H01Q 1/2291 343/752 |
| 2002/0030630 | A1 * | 3/2002 | Maeda et al. | 343/702 |
| 2002/0101382 | A1 * | 8/2002 | Konishi et al. | 343/702 |
| 2003/0001781 | A1 * | 1/2003 | Konishi | 343/700 MS |
| 2004/0027294 | A1 | 2/2004 | Zaitsev | |
| 2004/0150567 | A1 | 8/2004 | Yuanzhu | |
| 2004/0263407 | A1 * | 12/2004 | Inatsugu et al. | 343/725 |
| 2005/0024287 | A1 | 2/2005 | Jo et al. | |
| 2005/0099341 | A1 * | 5/2005 | Zhang et al. | 343/700 MS |
| 2006/0097921 | A1 | 5/2006 | Luk et al. | |
| 2006/0227989 | A1 * | 10/2006 | Polinske | H01Q 1/22 381/322 |
| 2007/0080889 | A1 | 4/2007 | Zhang | |
| 2007/0229369 | A1 * | 10/2007 | Platz | 343/702 |
| 2007/0257859 | A1 * | 11/2007 | Lashmore | B82Y 30/00 343/897 |
| 2008/0056520 | A1 * | 3/2008 | Christensen et al. | 381/323 |
| 2012/0001812 | A1 | 1/2012 | Zhao et al. | |
| 2012/0002830 | A1 * | 1/2012 | Solum | H04R 25/554 381/315 |
| 2012/0087506 | A1 | 4/2012 | Ozden | |
| 2012/0093324 | A1 * | 4/2012 | Sinasi | H01Q 1/273 381/23.1 |
| 2013/0129124 | A1 * | 5/2013 | Westermann et al. | 381/312 |
| 2013/0257676 | A1 * | 10/2013 | Kerselaers et al. | 343/860 |
| 2013/0295421 | A1 * | 11/2013 | Teramoto et al. | 429/61 |

OTHER PUBLICATIONS

Conway, G.A. et al., "An Antennas and Propagation Approach to Improving Physical Layer Performance in Wireless Body Area Networks", IEEE Journal on Selected Areas in Communications, vol. 27, No. 1, pp. 27-36 (Jan. 2009).

Extended European Search Report for EP Patent Appln. No. 13154708.5 (Jul. 12, 2013).

Communication pursuant to Article 94(3) EPC from counterpart application 13 154 708.5 (Feb. 19, 2015).

* cited by examiner

HEARING AID ANTENNA

CROSS-REFERENCE TO RELATED APPLICATIONS

This application claims the priority under 35 U.S.C. §119 of European patent application no. 13154708.5, filed on Feb. 8, 2013, the contents of which are incorporated by reference herein.

This application is a Continuation-in-Part of application Ser. No. 13/758,257 filed on Feb. 4, 2013.

FIELD OF THE INVENTION

The present invention is related to an antenna for communication systems and hearing aids as well as corresponding manufacturing methods. The present invention is directed to the use of a hearing aid or multiple hearing aids as wireless communication devices and in particular to communicate data and in particular high quality audio communication. High quality audio can be understood like CD like quality sound with larger bandwidth than voice audio.

BACKGROUND OF THE INVENTION

A basic hearing aid comprises a microphone, speaker and audio transceiver. In such hearing aids the earpiece microphone converts acoustic waves into electrical signals representing the acoustical waves, the electrical signals are amplified and eventual processed and converted back into acoustical waves.

Remote controls with functions to control the amplification and other settings of the earpiece are often used and offer possibly wireless communicating with the earpiece. Sometimes hearing aids with remote control function have an antenna that is external connected to the earpiece.

More advanced hearing aids use wireless audio communication between the two earpieces. The method often used to establish such a communication is based on magnetic coupling. A relative large voltage, which can be 12 volts AC, is subjected to a coil which generates a magnetic field. Within a short range of this coil, the magnetic field can induce voltage in a second coil. This method provides short range voice quality communication.

When communication has to be established across a larger range, conventional solutions use a radio module that works with electromagnetic radiation. In most existing solutions such a radio module is implemented in the remote control unit. A first communication is established between the earpiece and the remote control based on magnetic coupling and a second communication is established between the remote control and further electronic equipment like cellular phone or other by means of electromagnetic radiation. Several products based on this concept are on the market; some of them use the Bluetooth standard as the second communication protocol.

One hearing aid product can be found in the market today from GN Resound, with brand name Alera. This product has an integrated antenna that is designed to operate at the 2.4 GHz ISM band intended to be used for electromagnetic radiation. This antenna occupies large areas of the hearing aid and is not able to establish communication between two hearing aids, each positioned at one ear.

Another antenna is able to communicate between two hearing aids, each positioned at one ear. However this antenna occupies large areas of the hearing aid. The antenna relies on the construction of the hearing aid like the plastic housing, or part of it, and can also use conducting parts already available at the hearing aid, like parts conducting on printed circuit boards. This kind of antenna requires each time a lot of design effort when new models of hearing aid are introduced.

Background art is disclosed in: An Analytical Path-Loss Model for On-Body Radio Propagation, G. A. Conway, W. G. Scanlon, S. L. Cotton, M. J. Bentum, 2010 URSI International Symposium on Electromagnetic Theory, or: An Antennas and Propagation Approach to Improving Physical Layer Performance in Wireless Body Area Networks, Gareth A. Conway, Simon L. Cotton, William G. Scanlon, IEEE JOURNAL on selected areas in communications, Vol. 27, NO. 1, January 2009

SUMMARY OF THE INVENTION

According to an embodiment there is provided an antenna, in particular a dipole antenna, for radio communication in a hearing aid is provided, wherein the antenna comprises a solid three-dimensional dielectric support body, an electrically conductive first plate on a first surface of the support body, and an electrically conductive second plate on a second surface of the support body. The first surface and the second surface are arranged on opposing ends of the support body. An electrically conductive filament is arranged on and/or in the support body, electrically coupling the first plate with the second plate, and comprises first sections and second sections, wherein the second sections extend perpendicular to the first sections.

A dipole antenna in the sense of the embodiments of the invention may be a radio antenna for receiving, sending or transmitting radio waves. In contrast to a monopole antenna, a dipole antenna does not need a ground plane for its functioning. Dipoles may have a radiation pattern, shaped like a toroid (doughnut) symmetrical around the axis of the dipole. The radiation may be maximum at right angles to the dipole, dropping off to zero on the antenna's axis.

Radio communication in the sense of the embodiments of the invention may be all types of wireless communication by means of electromagnetic radiation and its protocols.

A hearing aid in the sense of the embodiments of the invention may be any type of device or apparatus, which provides audible signals to a human or human ear.

A solid three-dimensional dielectric support body in the sense of the embodiments of the invention may be a bulk body, a compound or frame, which has usable dimensions in all three dimensional axis. This is in contrast to a printed circuit board or a plate. Moreover the support body may be made of solid material. The first surface and the second surface of the support body may be arranged nearly parallel or parallel to each other, wherein nearly parallel may particularly mean an angle between the normal of the first surface of the support body and the second surface of the support body between 75° and 105°. Particular preferable, the first and the second surface of the support body may be arranged parallel to each other, forming an angle between the normal of the first surface of the support body and the second surface of the support body of 90°.

A plate in the sense of the embodiments of the invention may be any kind of electrical conductive plate, sheet, layer or the like arranged on the first and second surface of the support body. Preferable, the plates may be entirely made of electrical conductive material, but also only partially conductive plates are possible.

An electrically conductive filament in the sense of the embodiments of the invention may be any kind of electrically conductive basically one-dimensional filaments, like for example wires, conductive lines or tracks on a flex-form, or free-standing conductive wires or even very small strip-line or the like. The filament may be arranged on the surface of the support body or within the support body or as a mix of both arrangements. Moreover the filament may have a bent structure, meaning a curved or meandered extension, preferably a nearly 90° curved and/or 90° curved extension. Particular preferable, the filament may have a bent structure forming a 90° meandered structure.

Electrical coupling in the sense of the embodiments of the invention may denote the capability of a transfer of electrical energy from the first plate to the second plate or vice versa and/or from one electrical circuit section to another electrical circuit section. Electrical coupling for instance may be achieved by capacitive coupling, inductive coupling or in particular may be achieved through an electrical connection by wire or the like.

A section of the filament in the sense of the embodiments of the invention may be a part of the filament differing from another part of the filament regarding its spatial orientation. The first sections of the filament all have the same and/or nearly the same orientation of extension. Also the second sections of the filament have the same and/or nearly the same orientation of extension, significantly differing from the orientation of the extension of the first sections. Preferably the orientations of the extension of the first sections are the same and/or nearly the same as the orientation of extension of the support body. The orientation of the extension of the support body is the orientation of the distance between the first and second surface of the support body. The preferred orientations of the extension of the second sections are parallel and/or nearly parallel to the orientation of extension of the support body. Therefore, preferably the orientations of extension of the first sections are perpendicular and/or nearly perpendicular to the orientation of extension of the second sections. Particular preferable, the orientation of extension of the first sections is perpendicular to the orientation of extension of the second sections, while the orientation of extension of the second sections is parallel to the orientation of extension of the support body.

This embodiment provides at least the advantage of providing an antenna that has an electrical length compared with a half wave dipole and can be integrated into a hearing aid or a hearing communication device and/or apparatus.

The plates and the support body may function as a capacitor, while the filament may function as an inductor. In combination this may result in a compact, scalable, robust and easy manufacturable antenna.

According to another example embodiment of the invention a hearing aid for supplying acoustic waves with an audible content to a user is provided, wherein the hearing aid comprises an antenna having the above mentioned features and being at least configured for receiving electromagnetic radiation being indicative of the audible content.

An audible content in the sense of the embodiments of the invention may be any kind of content intended for the audio band, thus intended for providing audio information to a human user.

This embodiment provides at least the advantage of providing a hearing aid using the above described antenna, thus providing an easy adaptable hearing aid solution, by using modular components, which may be developed widely independent from each other. With this the advantage may be achieved, to provide a flexible, easy to use, easy to adapt and cost sensitive solution for a wireless hearing aid and related devices like a wireless remote control and the like.

According to yet another example embodiment of the invention a method of manufacturing an antenna for radio communication in a hearing aid is provided, wherein the method comprises forming a three-dimensional dielectric support body, forming an electrically conductive first plate on a first surface of the support body, forming an electrically conductive second plate on a second surface of the support body, comprising the first surface and the second surface on opposing ends of the support body. The method further comprises arranging an electrically conductive filament on and/or in the support body, electrically coupling the first plate with the second plate by the filament, and arranging the filament to thereby form first sections and second sections, the second sections extending perpendicular to the first sections.

This embodiment provides at least the advantage of providing a method for manufacturing an antenna having the above mentioned features with reasonable effort.

In the following, further example embodiments of the antenna, the hearing aid and the method will be explained.

According to another example embodiment of the invention the antenna comprises a first and a second feeding connection as electric interfaces, wherein both feeding connections are electrically connectable or connected to a signal processing device for processing an electrical signal received or to be transmitted by the antenna.

A feeding connection in the sense of the embodiments of the invention may be a connection for connecting the antenna with a signal processing device or apparatus, for feeding in or feeding out electrical signals and/or electromagnetic waves from the antenna to the signal processing device or apparatus and/or vice versa.

Preferably, either both feeding connections are electrically connected to a respective one of the second sections of the filament, or the first feeding connection is electrically connected to a respective one of the first or second plate and the second feeding connection is electrically connected to a respective one of the second sections of the filament.

A signal processing device or apparatus in the sense of the embodiments of the invention may be any kind of device or apparatus or even parts of it, related to wireless radio communication, preferably related to audio wireless radio communication. It may for instance process the electric signal to convert it to a signal being directly reproducible by a loudspeaker or the like.

This embodiment provides at least the advantage of providing an antenna for hearing aids or other communication systems that does not rely on the housing, or part of it or other major components of the product to function properly.

According to another example embodiment of the invention the support body is cylindrically shaped, in particular prismatically or circular cylindrically shaped.

This embodiment provides at least the advantage of providing an antenna that has an easily and cost efficient fabricable support body for the antenna.

According to another example embodiment of the invention the first sections are arranged for conducting currents that generate fields, such that polarization of these fields each parallel with an axis through a corpus is obtained, when the antenna is attached to the corpus.

Fields in the sense of the embodiments of the invention may be electric, magnetic and/or electromagnetic fields generated by the current conducting sections of the filament of the antenna.

The generated fields in the first sections of the filament may add up to a resulting field that has a polarization parallel with an axis through a corpus, when the antenna is attached to the corpus.

Corpus in the sense of the embodiments of the invention may be a human body or at least parts of a human body, like arms, legs, chest or head, preferably a human head.

For efficient communication between two systems attached to the human body antennas are useful that radiate electromagnetic waves along the surface of the body or in case of a hearing aid along the head. The required polarization of the antenna, which is defined by the vector direction of the electrical field, should be normal with the surface of the body. In case of a hearing aid the electrical field polarization should be parallel with the axis going through both ears. This finding can be used with advantage at the 2.5 GHz ISM band, which waves have a wavelength of 12 cm, for hearing aids since the dimensions of the head are such that electromagnetic propagation is established around the head.

Antennas that are resonant have a standing wave current distribution along its length. Multiple maximums or minimums can be found depending on the antenna length which can be a multiple of 0.5 wavelengths. The polarization of an antenna may be defined by the current distribution along the antenna length. In a linear antenna like a half wave center fed antenna the current amplitude may be a maximum at the feeding connections and minimum at the open ends of the antenna. The polarization may be in parallel with the antenna. When the antenna is not in a straight line the polarization is mainly defined by the highest current amplitude distributed along a certain length, lower currents like near open ends have less impact on defining the polarization.

This embodiment provides at least the advantage of providing an antenna, wherein that electromagnetic propagation is established around the corpus the antenna is attached to, which preferably is the head of a human body. Another advantage of this embodiment is that an efficient way of communication between two systems or devices attached to a human body may be provided.

According to another example embodiment of the invention the second sections are arranged for conducting currents that generate fields that at least partially, preferably entirely, cancel or compensate each other.

Canceling each other in the sense of the embodiments of the invention may be the damping and/or absorption of the created fields, by currents flowing in opposing directions through different second sections of the filament.

The proposed electromagnetic antenna according to this embodiment provides an increased communication range compared with magnetic induction technology, while it can be embedded into a hearing aid or other communications system. It may generate an electrical field in a direction parallel with the axis through both ears when the hearing aid is worn, by allowing currents in that direction and cancelling mainly other field by means of opposite currents.

This embodiment provides at least the advantage that unwanted fields generated by currents which flow in other directions than the desired direction or directions for the desired polarization of the antenna may be reduced or eliminated.

According to another example embodiment of the invention the support body is made of a material having a value of the dielectric constant between 1 and 50, preferably between 1 and 20, in particular between 1 and 10. However, in an embodiment the value of the dielectric constant may be larger than 1.1.

The dielectric constant in the sense of the embodiments of the invention may be the relative permittivity of a material for a frequency of an electrical current of zero hertz, $\epsilon_r$.

This embodiment provides at least the advantage that the support body does not add into unwanted polarization of the antenna and does not significantly reduce the magnitude of the generated desired field.

According to another example embodiment of the invention the first plate and the second plate are spaced from each other by a distance in a range of 1/30 to 1/4 of a predefined operation wavelength.

The operation wavelength in the sense of the embodiments of the invention may the wavelengths at which audio communication is desired. It may be the wavelength that generates a propagation mode between two communication devices.

Integrating an antenna that suits electromagnetic radiation in a hearing aid faces different problems. A hearing aid has usually a dedicated design and is has a small volume. There is very little volume left for the antenna. It is well known in the art that the antenna volume defines the antenna parameters. Size of an antenna can be expressed as "ka" where k is the free space wave number $2\pi/\lambda$, where $\lambda$ is the free space wavelength, and "a" is the radius of an imaginary sphere circumscribing the maximum dimension of the antenna. A value of $ka \leq 0.5$ is considered as electrically small antenna.

This embodiment provides at least the advantage that the antenna may be manufactured in a compact way.

According to another example embodiment of the invention the filament is adapted to be functioning as a distributed inductance, the both plates are adapted to be functioning as plates of a capacitor and the support body is adapted to be functioning as a dielectric medium of the capacitor.

A distributed inductance in the sense of the embodiments of the invention may be formed by the inductive part of each first and second section of the filament.

With this the antenna may form an LC element or an LC circuit needed for efficient sending, receiving and/or transmitting of the desired audio signal.

This embodiment provides at least the advantage that the entirely antenna forms a LC element or a LC circuit, thus providing an easy to fabricate and cost efficient antenna solution.

According to another example embodiment of the invention the antenna is adapted for creating an electric and/or magnetic field, which produces an electromagnetic wave, travelling along and/or around a corpus, when the antenna is attached to the corpus.

At UHF and higher frequencies like 2.5 GHz, penetration through the body may be significantly reduced and the main mechanism for propagation around the body may be via a creeping wave that follows the dielectric-air interface at the body surface. Such propagation may be initiated by an on-body antenna which directs maximum radiation tangential to the body surface, minimizing off-body radiation, maximizing path gain between body-worn devices. For on-body systems, where both the transmitting and receiving antennas are positioned close to the body surface, there are a number of wave propagation mechanisms: the direct (space) wave, reflected waves, surface waves and diffracted creeping waves. The E-field tangential with the surface of the skin generated by an antenna close to the surface of the human body produces an electromagnetic wave that travels along and around the surface of the body. The creeping wave propagation mechanism can be shown by the electric field component of the wave which propagates around the surface of the media to a receive location on the back of the body or head.

This embodiment provides at least the advantage that a first antenna positioned close to the body surface may induce a current in a second antenna positioned close to the body surface at a different position than the first antenna at higher maximum distances compared to commonly known solutions.

According to another example embodiment of the invention the hearing aid further comprises a loudspeaker configured for generating the acoustic waves based on an electrical signal received by the antenna.

This embodiment provides at least the advantage that a wireless hearing aid device may be easily fabricated, with an integrated loudspeaker as another modular component of the hearing aid.

According to another example embodiment of the invention the hearing aid further comprises a further antenna having the above mentioned features and being at least configured for receiving electromagnetic radiation being indicative of the audible content, and a further loudspeaker configured for generating the acoustic waves based on an electrical signal received by the further antenna, so that the loudspeakers provide binaural acoustic waves to the user.

Binaural acoustic waves in the sense of the embodiments of the invention may be electromagnetic waves, which may be converted into stereo audio signals.

This embodiment provides at least the advantage that an easy way of providing at least two channel (stereo) audio communication may be established by enduring and effective using of modular components described in the invention.

According to another exemplary method for manufacturing a herein disclosed antenna, the method further comprises designing the filament for manipulating a distributed inductance of the antenna to adjust an operation frequency of the antenna to a predefined target operation frequency.

This embodiment provides at least the advantage that an antenna may be manufactured, that has a smaller size than conventionally known antennas, by still providing the same operation frequency as needed by other antennas which shall operate at the same predefined target operation frequency.

According to another exemplary method for manufacturing a herein disclosed antenna, the method further comprises designing the distributed inductance to obtain resonation of the antenna at a half wavelength of a predefined target operation wavelength.

This embodiment provides at least the advantage that an antenna may be manufactured, that has a smaller size than conventionally known antennas, by still providing the same resonation wavelength as needed by other antennas which shall operate at the same predefined target operation wavelength.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
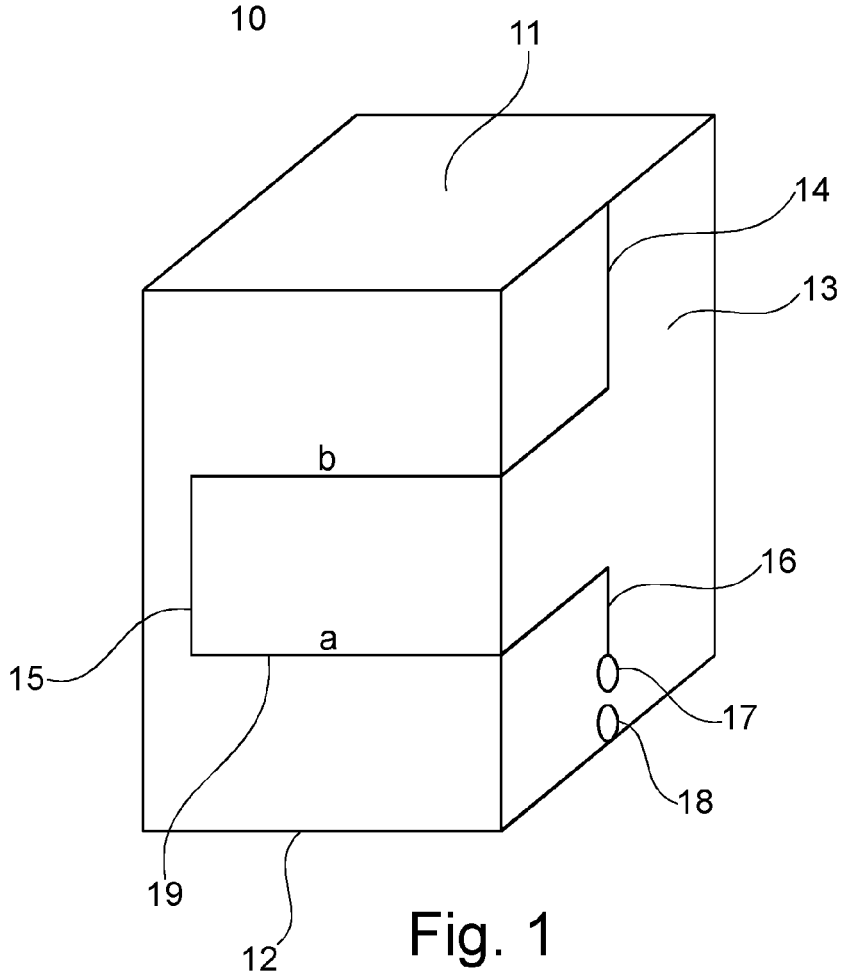
FIG. 1 illustrates a first example of a proposed antenna according to an example embodiment of the invention.

The illustration in the drawing is schematical. In different drawings, similar or identical elements are provided with the same reference signs.

Figure 2A:
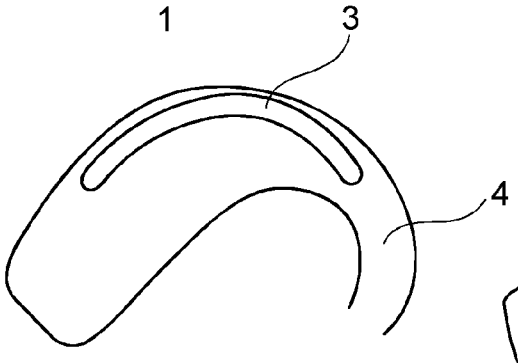
FIG. 2*a* illustrates a side view of a conventional hearing aid antenna of a hearing aid.

FIG. 2*a* illustrates a conventional antenna 1' in a hearing aid used for electromagnetic on-body communication.

Integrating an antenna 1' that suits electromagnetic radiation in a hearing aid faces different problems. A hearing aid has usually a dedicated design and is has a small volume. There is very little volume left for the antenna. It is well known in the art that the antenna volume defines the antenna parameters. Size of an antenna can be expressed as "ka" where k is the free space wave number $2\pi/\lambda$, where $\lambda$ is the free space wavelength, and "a" is the radius of an imaginary sphere circumscribing the maximum dimension of the antenna. A value of $ka \leq 0.5$ is considered as electrically small antenna.

FIG. 2*a, b, c* each illustrate the same conventional antenna 1 in a hearing aid used for electromagnetic on-body communication.

The antenna conducting parts use a large area of the hearing aid to resonate the antenna at the frequency band of operation and uses existing hearing aid components for attaching the antenna 4, 6, 7. The antenna consists of two conducting elements 3, 5. Element 3 is not in a straight line but has two subparts from which one part is parallel with the axis going through both ears when the hearing aid is at the wearing position. The antenna feeding points 8, 9 are connected to subpart 3 and element 5. The current amplitude at the feeding connections is high compared with the overall antenna current while subpart 3 is parallel with the axis through both ears when the hearing aid is at the wearing position so that direction of subpart 3 is defining mainly the polarization of the antenna.

FIG. 1 illustrates a first example of a proposed antenna 10 according to an example embodiment of the invention.

The antenna comprises conducting elements that are positioned around a relative small volume, as small as 1/30 of a wavelength. The volume contains material with a relative low dielectric constant like air or for example Polyethylene. Relative low dielectric constant means one to ten. The material purpose is for the antenna and not for another function in the hearing aid.

The conducting elements are arranged in such a way that the polarization of the antenna is parallel with the axis through both ears when the hearing aid is at the wearing position.

Figure 2B:
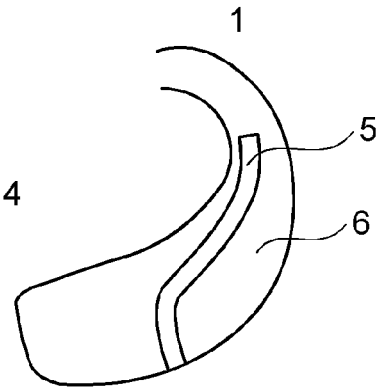
FIG. 2*b* illustrates a another side view of a conventional hearing aid antenna of the hearing aid of FIG. 2*a;*
Figure 2C:
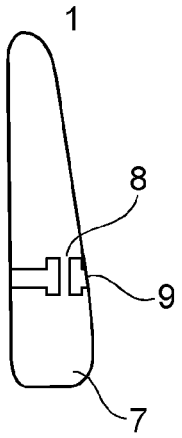
FIG. 2*c* illustrates a top view of a conventional hearing aid antenna of the hearing aid of FIGS. 2*a* and 2*b;*

In FIG. 1 the antenna 10 is a dipole antenna, for radio communication in a hearing aid, and the antenna comprises: A solid three-dimensional dielectric support body 13; an electrically conductive first plate 11 on a first surface of the support body 13; an electrically conductive second plate 12 on a second surface of the support body 13; and an electrically conductive filament arranged on and/or in the support body 13, electrically coupling the first plate 11 with the second plate 12, and comprising first sections 14, 15, 16 and second sections 19*a*, 19*b*, the second sections 19*a*, 19*b* extending perpendicular to the first sections 14, 15, 16. The first surface and the second surface are arranged on opposing ends of the support body 13. In this embodiment the filament has a bent meandered structure. Moreover the antenna 10 comprises a first and a second feeding connection 17, 18, wherein both feeding connections 17, 18 are electrically connectable to a signal processing device (not shown) for processing an electrical signal received or to be transmitted by the antenna 10. The support body 13 in FIG. 2 is prismatically shaped. The first sections 14, 15, 16 are arranged for conducting currents that generate fields, such that polarization of these fields each parallel with an axis through a corpus (not shown) is obtained, when the antenna 10 is attached to the corpus (not shown). The second sections 19*a*, 19*b* are arranged for conducting currents that generate fields that cancel each other. The support body 13 is made of a material having a dielectric constant between 1 and 50, preferably between 1 and 20, in particular between 1 and 10. The first plate 11 and the second plate 12 are spaced from each other by a distance in a range of 1/30 to 1/4 of a predefined operation wavelength. The filament is adapted to be functioning as a distributed inductance, the both plates 11, 12 are adapted to be functioning as plates of a capacitor and the support body 13 is adapted to be functioning as a dielectric medium of the capacitor. The antenna 10 is adapted for creating an electrical field, which produces an electromagnetic wave, travelling along and/or around the corpus (not shown). The filament in the illustrated embodiment of FIG. 1 extends over two sides of the prismatically shaped support body 13.

Figure 3:
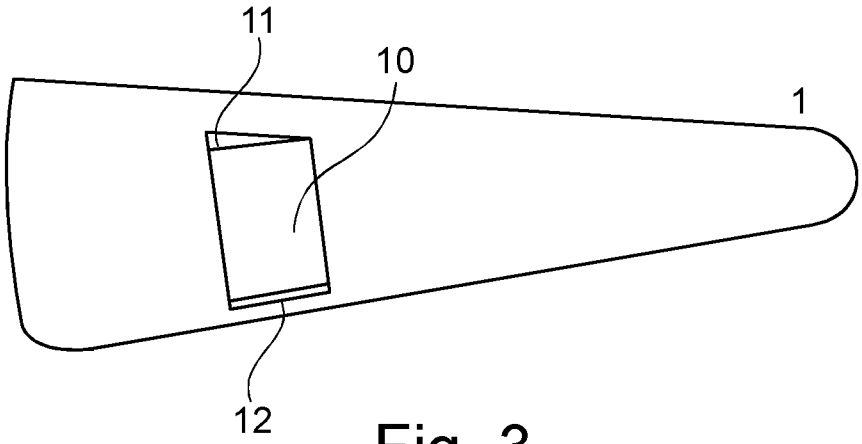
FIG. 3 illustrates a positioning of a proposed antenna in a hearing aid according to an example embodiment of the invention.
Figure 4:
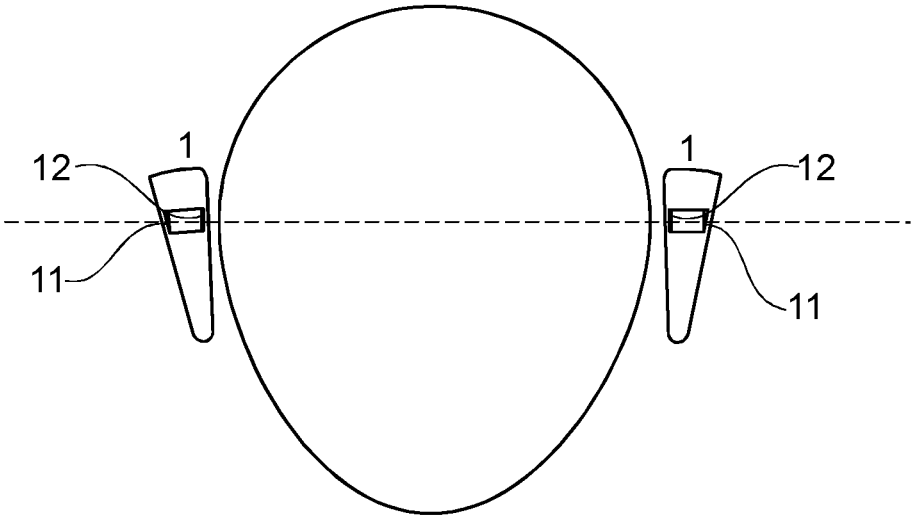
FIG. 4 illustrates a positioning of proposed antennas in hearing aids in relative to the human head according to an example embodiment of the invention.

FIG. 3 and FIG. 4 illustrate a positioning of a proposed antenna in a hearing aid according to an example embodiment of the invention a positioning of proposed antennas in a pair of hearing aids in relative to the human head according to an example embodiment of the invention. They illustrate the positioning of the antenna in the hearing aid and the hearing aids on the head. FIG. 4 illustrates the top view of a head with the axis through both ears.

FIG. 3 moreover illustrates an example of a hearing aid 1 according to an example embodiment of the invention. The hearing aid 1 comprises an antenna 10 according to an example embodiment of the invention, at least configured for receiving electromagnetic radiation being indicative for the audible content. Moreover the hearing aid 1 comprises a loudspeaker (not shown) configured for generating the acoustic waves based on an electrical signal received by the antenna 10. Additional conducting parts already in the hearing aid 1 may enhance the operation of the antenna. FIG. 4 moreover illustrates an example of a pair of hearing aids 1 according to an example embodiment of the invention and worn around a human head. The pair of hearing aids 1 comprises a further antenna 10 according to an example embodiment of the invention, at least configured for receiving electromagnetic radiation being indicative for the audible content; and a further loudspeaker (not shown) configured for generating the acoustic waves based on an electrical signal received by the further antenna 10; so that the loudspeakers (not shown) provide binaural acoustic waves to the user.

Figure 5:
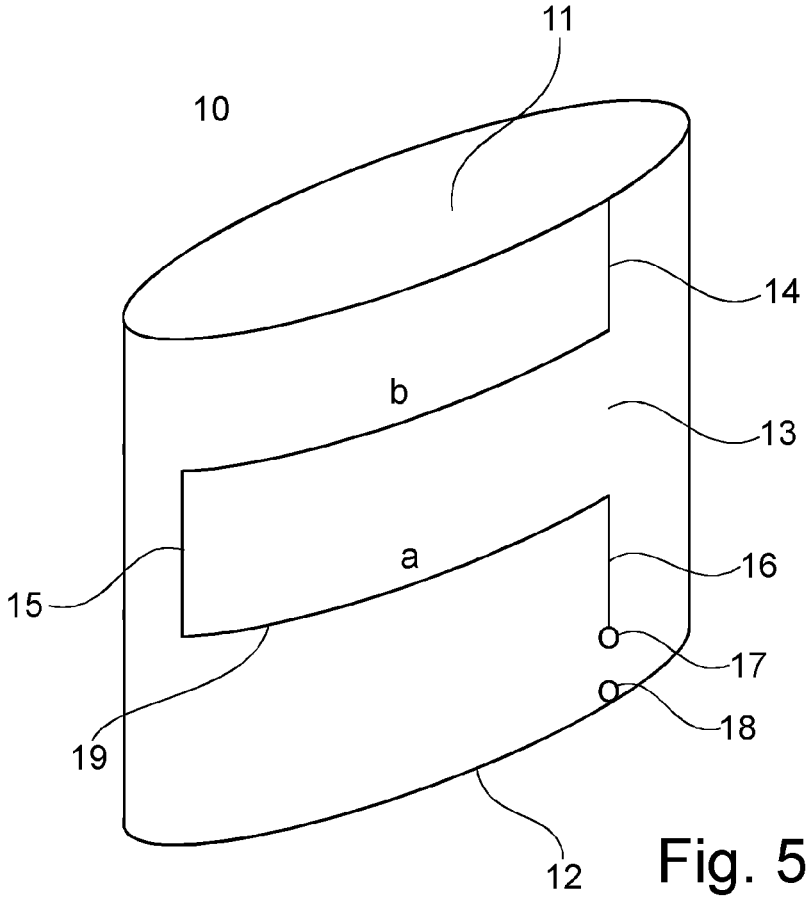
FIG. 5 illustrates a second example of a proposed antenna according to an example embodiment of the invention.
Figure 6:
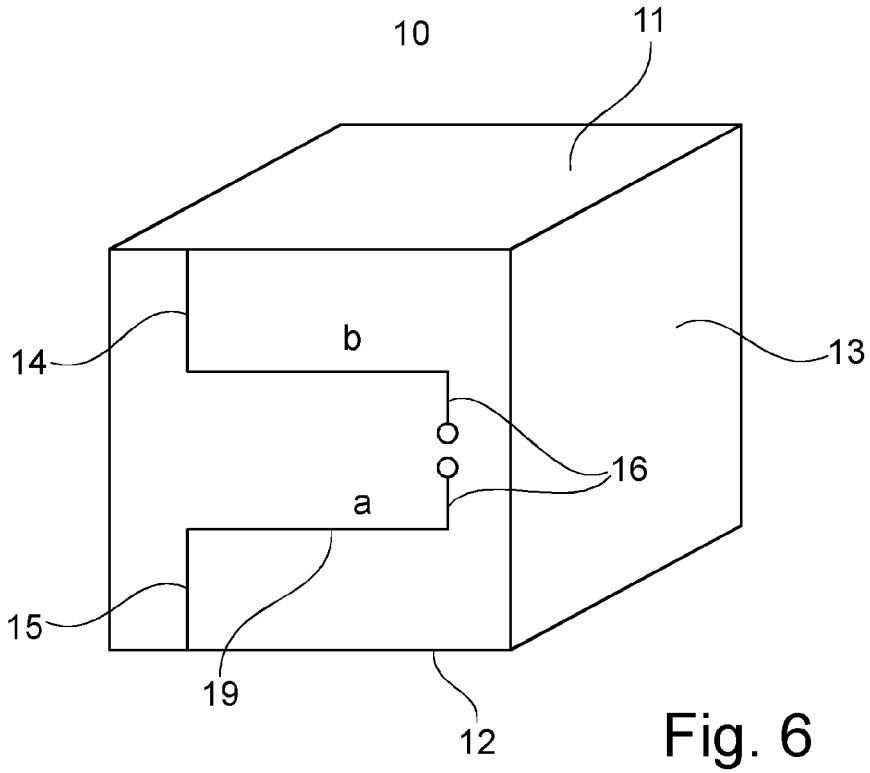
FIG. 6 illustrates a third example of a proposed antenna according to an example embodiment of the invention.

FIG. 5 and FIG. 6 Illustrates a second and a third example of a proposed antenna according to an example embodiment of the invention.

In FIG. 5 the support body 13 is circular cylindrically shaped.

Although FIG. 3 and FIG. 4 show behind the ear (BTE) hearing aids, other form factors like in the ear (ITE) or in the ear channel (IEC) are possible with the proposed antenna.

The conducting parts and feeding connections of the antenna are arranged so that multiple parts conduct current in the direction parallel with of the axis through the ears when the hearing aid is worn. Other parts are conducting currents that generate fields that cancel each other out. For example in FIG. 1 the conductive parts 14, 15 and 16 conduct current in the direction parallel with the axis through the ears when the hearing aid is worn. The conductive parts 19*a* and 19*b* conduct currents that have mainly opposite direction that cancel each other fields and do not add to the radiation. The conductive parts 11 and 12 are surfaces that conduct currents that have mainly opposite direction that cancel each other's fields and do not add to the radiation.

Parts 11, 12, 14, 15, 16, 19*a* and 16*b* are all conductive parts while volume 13 represents dielectric material. The conductive parts can be in one plane or not.

A resonating antenna is preferred to have a certain electrical length to operate properly, for example half wavelength or a multiple here from. In this proposed antenna, conductive surfaces 11 and 12 together with the low valued dielectric material, are too small and too close to each other to form a half wave antenna. The dimensions in a hearing aid are minimum 1/30 of a wavelength but can be as large as 1/4 of a wavelength in other communication devices. The antenna is resonating at the half wavelength due to the conductive parts 14, 15, 16 and 19*a* and 19*b* that function as distributed inductance. Such inductance decreases the resonance frequency and by proper design the operating frequency can be obtained.

In FIG. 1, the feeding connection 17 is connected to conducting part 16. Another feeding connection 18 is connected to conducting surface 12. FIG. 6 illustrates the feeding connections chosen at another position. The feeding connections are connected to a communication radio. A matching unit may be used between the feeding connections and the communication radio. The matching unit can be lumped components but may be distributed.

The concept is not limited to the three examples but can be used at different shapes and sizes as long as the main principles are followed; allow currents in direction parallel with the axis through both ears when the hearing aid is at the wearing position and cancel out other fields by means of currents mainly in opposite direction.

Figure 7:
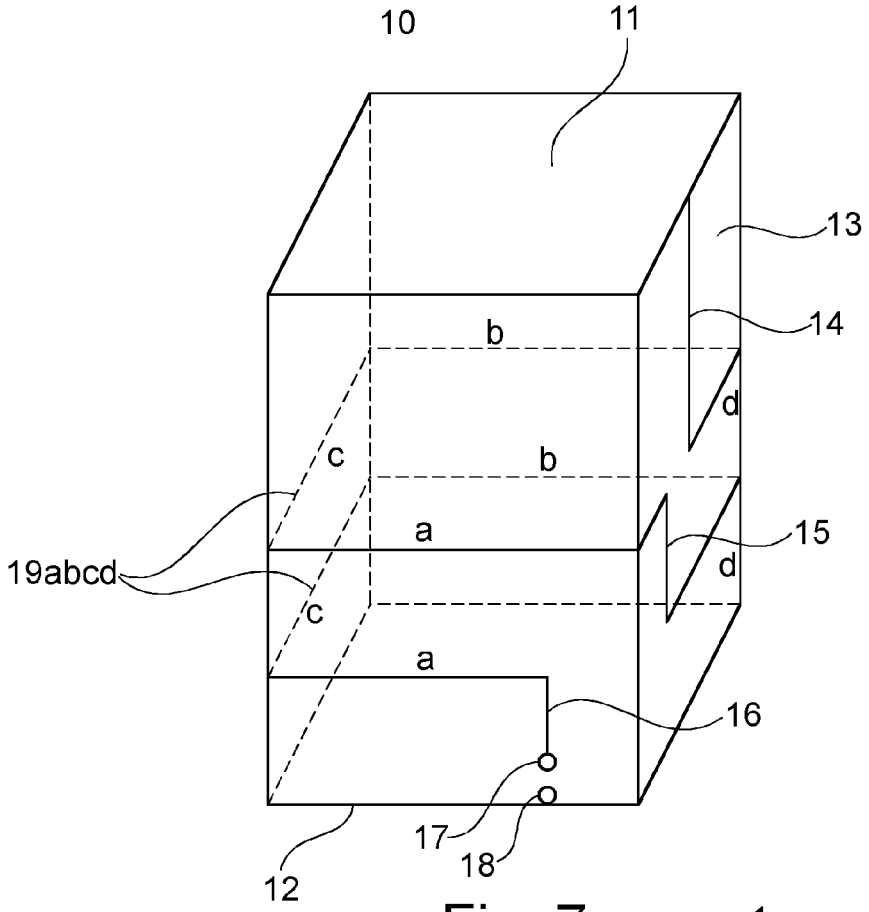
FIG. 7 illustrates a fourth example of a proposed antenna according to an example embodiment of the invention.

FIG. 7 illustrates a fourth example of a proposed antenna according to an example embodiment of the invention. The antenna consists of conducting elements 11, 12 that are positioned around a relative small volume 13, as small as 1/30 of a wavelength. The volume contains material with a relative low dielectric constant like air or for example Polyethylene. Relative low dielectric constant means one to ten. The material purpose is for the antenna and not for another function in the hearing aid. All conducting elements are arranged in such a way that the polarization of the antenna is mainly parallel with the axis through both ears when the hearing aid is at the wearing position. The two conducting elements 11, 12 are connected by means of a conductive filament that introduces inductance and hereby reduces the resonance frequency of the antenna. The conductive filament has parts 14,15,16 that generate electric field vector perpendicular to conducting elements 11, 12. Section 19 of the conductive filament contains subsections that are positioned mainly parallel with the conductive elements 11, 12. Section 19 contain subsections, a, b and c, d that mainly do not contribute to the electromagnetic radiation.

Figure 8:
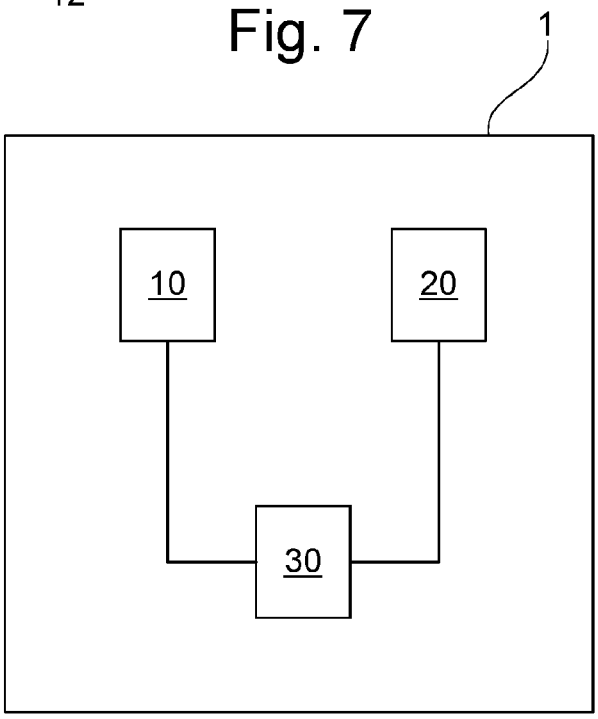
FIG. 8 illustrates a block diagram of an example of a proposed hearing aid according to an example embodiment of the invention.

FIG. 8 illustrates a block diagram of an example of a proposed hearing aid according to an example embodiment of the invention. In FIG. 8 the hearing aid 1 comprises an antenna 10 according to an example embodiment of the invention, a loudspeaker 20 and a hearing aid electronics 30 with integrated circuits on it. The hearing aid electronics 30 comprises for example a printed circuit board (PCB). Instead of a PCB also a system on a chip, a chip on module or the like may be used to integrate the needed electrical circuits and methods needed to create from received electromagnetic waves in the antenna 10 acoustic waves in the loudspeaker 20 and the other way around. Therefore the antenna 10 and the loudspeaker 20 each are connected to the hearing aid electronics 30.

It should be noted that the term "comprising" does not exclude other elements or features and the "a" or "an" does not exclude a plurality. Also elements described in association with different embodiments may be combined.

It should also be noted that reference signs in the claims shall not be construed as limiting the scope of the claims.

LIST OF REFERENCE NUMBERS

1' conventional antenna
1 hearing aid
10 antenna
11 electrically conductive first plate
12 electrically conductive second plate
13 electrically conductive support body
14, 15, 16 first sections of the electrically conductive filament
17, 18 first and second feeding connections
19*a*, 19*b*, 19*c*, 19*d* second sections of the electrically conductive filament
20 loudspeaker
30 hearing aid electronics

The invention claimed is:

1. An antenna in a hearing aid, the antenna comprising:
a solid three-dimensional dielectric support body;
an electrically conductive first plate on a first surface of the support body;
an electrically conductive second plate on a second surface of the support body, wherein the first surface and the second surface are arranged on opposing ends of the support body;
an electrically conductive filament arranged on and/or in the support body configured to reactively couple the first plate with the second plate, comprising first sections and second sections, wherein the second sections are perpendicular to the first sections.

2. The antenna according to claim 1, further comprising:
a first feeding connection; and
a second feeding connection, wherein both feeding connections are electrically connectable to a signal processing device that is configured to process an electrical signal received or to be transmitted by the antenna.

3. The antenna according to claim 1, wherein the support body is cylindrically shaped.

4. The antenna according to claim 1, wherein the first sections are configured to conduct currents that generate fields, such that polarization of these fields each parallel with an axis through a corpus is obtained, when the antenna is attached to the corpus.

5. The antenna according to claim 1, wherein the second sections are configured to conduct currents that generate fields that at least partially, cancel each other.

6. The antenna according to claim 1, wherein the support body is made of a material having a dielectric constant between 1 and 50.

7. The antenna according to claim 1, wherein the first plate and the second plate are spaced from each other by a distance in a range of 1/30 to 1/4 of a predefined operation wavelength.

8. The antenna according to claim 1, wherein the filament is configured to be functioning as a distributed inductance, both plates are configured to be functioning as plates of a capacitor, and the support body is configured to be functioning as a dielectric medium of the capacitor.

9. The antenna according to claim 1, wherein the antenna is configured to create an electric and/or magnetic field, which produces an electromagnetic wave, travelling along and/or around a corpus, wherein the antenna is attached to the corpus.

10. A hearing aid configured to supply acoustic waves with an audible content to a user, the hearing aid comprising:
the antenna of claim 1 configured to receive electromagnetic radiation being indicative of the audible content.

11. The hearing aid of claim 10, further comprising:
a loudspeaker configured to generate the acoustic waves based on an electrical signal received by the antenna.

12. The antenna according to claim 1, wherein the antenna is a dipole antenna.

13. The antenna according to claim 3, wherein the support body is prismatically cylindrically shaped.

14. The antenna according to claim 3, wherein the support body is circular cylindrically shaped.

15. The antenna according to claim 6, wherein the support body is made of a material having a dielectric constant between 1 and 20.

16. The hearing aid of claim 11, further comprising:
a further antenna of claim 1 at least configured to receive electromagnetic radiation being indicative of the audible content; and
a further loudspeaker configured to generate the acoustic waves based on an electrical signal received by the further antenna; so that the loudspeakers are configured to provide binaural acoustic waves to the user.

17. The antenna according to claim 15, wherein the support body is made of a material having a dielectric constant between 1 and 10.

18. A method of manufacturing an antenna for radio communication in a hearing aid, the method comprising:
forming a solid three-dimensional dielectric support body;
forming an electrically conductive first plate on a first surface of the support body;
forming an electrically conductive second plate on a second surface of the support body, wherein the first surface and the second surface are arranged on opposing ends of the support body;

arranging an electrically conductive filament on and/or in the support body;

reactively coupling the first plate with the second plate by the electrically conductive filament; and arranging the electrically conductive filament to thereby form first sections and second sections.

19. The method according to claim 18, further comprising:

designing the electrically conductive filament for manipulating a distributed inductance of the antenna to adjust an operation frequency of the antenna to a predefined target operation frequency.

20. The method according to claim 19, further comprising:

designing the distributed inductance to obtain resonation of the antenna at a half wavelength of a predefined target operation wavelength.

* * * * *